US006904880B2

(12) United States Patent
Green et al.

(10) Patent No.: US 6,904,880 B2
(45) Date of Patent: Jun. 14, 2005

(54) VCT SENSOR AND ACTUATOR MODULE

(75) Inventors: John C. Green, Sterling Heights, MI (US); Robert J. Telep, Livonia, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/731,320

(22) Filed: Dec. 9, 2003

(65) Prior Publication Data

US 2005/0072391 A1 Apr. 7, 2005

Related U.S. Application Data

(60) Provisional application No. 60/508,957, filed on Oct. 6, 2003.

(51) Int. Cl.[7] ..... F01L 1/34

(52) U.S. Cl. ..... 123/90.15; 123/90.18; 123/90.27; 123/90.38; 123/195 C

(58) Field of Search ..... 123/90.15, 90.18, 123/90.27, 90.38, 195 C, 198 E

(56) References Cited

U.S. PATENT DOCUMENTS 4,614,111 A 9/1986 Wolff ..... 73/119 A
5,912,556 A 6/1999 Frazee et al. ..... 324/207.2
6,056,908 A * 5/2000 Petrosky et al. ..... 137/884
6,435,154 B1 8/2002 Simpson et al. ..... 123/195 C
6,439,176 B1 8/2002 Payne et al. ..... 123/90.12
6,688,265 B2 * 2/2004 Gramkow et al. ..... 123/90.15

* cited by examiner

*Primary Examiner*—Tony M. Argenbright
(74) *Attorney, Agent, or Firm*—Brown & Michaels, PC; Greg Dziegielewski

(57) ABSTRACT

A lead frame disposed within the confines of an engine cover, having an insulating portion and an electrically conducting portion. The conducting portion has at least one electrically conducting interconnect. Both the insulating portion and the electrically conducting portion form an integral piece for retaining and accurately positioning devices within an internal combustion engine. The lead frame includes a plurality of retaining elements for retaining or positioning of at least some of the devices; and an electrical connector member extending outside the confines of the internal combustion engine, the electrical connector member having a plurality of electrically conducting terminals in electrical communication with at least some of the devices within the internal combustion engine by means of the at least one electrically conducting interconnect, whereby at least some of the devices are retained and accurately positioned within the internal combustion engine.

4 Claims, 9 Drawing Sheets

VCT SENSOR AND ACTUATOR MODULE

REFERENCE TO PROVISIONAL APPLICATION

This application claims an invention which was disclosed in Provisional Application No. 60/508,957, filed Oct. 6, 2003, entitled "VCT SENSOR AND ACTUATOR MODULE". The benefit under 35 USC §119(e) of the United States provisional application is hereby claimed, and the aforementioned application is hereby incorporated herein by reference.

FIELD OF THE INVENTION

The invention pertains to the field of variable cam timing (VCT). More particularly, the invention pertains to a variable cam timing (VCT) sensor and actuator module.

BACKGROUND OF THE INVENTION

U.S. Pat. No. 6,435,154, which is incorporated herein by reference, discloses a front cover for an internal combustion engine that comprises variable cam timing (VCT) controls integrated into the cover. The controls include a variable force solenoid (VFS) and a cam position sensor located in front of, and operably connected to a cam phaser. In an embodiment of the invention, the engine cover, once assembled, comprises a single unit having an electronic interface module (EIM), VFS and position sensor integrated within said cover.

However, electrical leads of the electrical system involved are generally independently or individually connected inside the engine cover, creating undesirable results such as complicated wiring because of increased numbers of independent wiring and connections. Other undesirable results include increased difficulty in installing and repairing the components the electrical leads terminate, sealing problems or the lack of proper sealing because of the increased number of leads leading out of the engine. It should be noted that inside the engine cover, there is oil or oil splashes. These oil or oil splashes affects the integrity of stranded wire and its connections to terminals within the engine cover in the presence of high levels of oil splash, heat, and vibration. To prevent the above occurrence is a sizeable task. Therefore, it is desirable to incorporate all the suitable electrical leads into a single consolidated member.

Further, it is well known to use lead frames in the computer chip manufacturing art. A lead frame, in the computer chip manufacturing art, is defined as a member used to make a resin encapsulation package, which encapsulates a semiconductor chip and is mounted on a substrate, such as a printed circuit board, to electrically connect the semiconductor chip to the substrate.

SUMMARY OF THE INVENTION

A lead frame incorporating all the suitable electrical wiring is provided. The lead frame has at least one electrical connector leading out of the engine cover.

In a VCT system, a single member incorporating all the suitable electrical wiring is provided. The single member has at least one electrical connector leading out of the engine cover.

A leadframe/housing member is provided which retains and accurately positions a number of devices internally within the engine valve/cam/timing area and communicates forces, energy, or electrical signals between components inside the engine cover and other components.

Accordingly, a lead frame disposed within the confines of an engine cover, having an insulating portion and an electrically conducting portion is provided. The conducting portion has at least one electrically conducting interconnect. Both the insulating portion and the electrically conducting portion form an integral piece for retaining and accurately positioning devices within an internal combustion engine. The lead frame includes a plurality of retaining elements for retaining or positioning of at least some of the devices; and an electrical connector member extending outside the confines of the internal combustion engine, the electrical connector member having a plurality of electrically conducting terminals in electrical communication with at least some of the devices within the internal combustion engine by means of at least one electrically conducting interconnect, whereby at least some of the devices are retained and accurately positioned within the internal combustion engine.

DESCRIPTION OF THE PREFERRED EMBODIMENT

Figure 1:
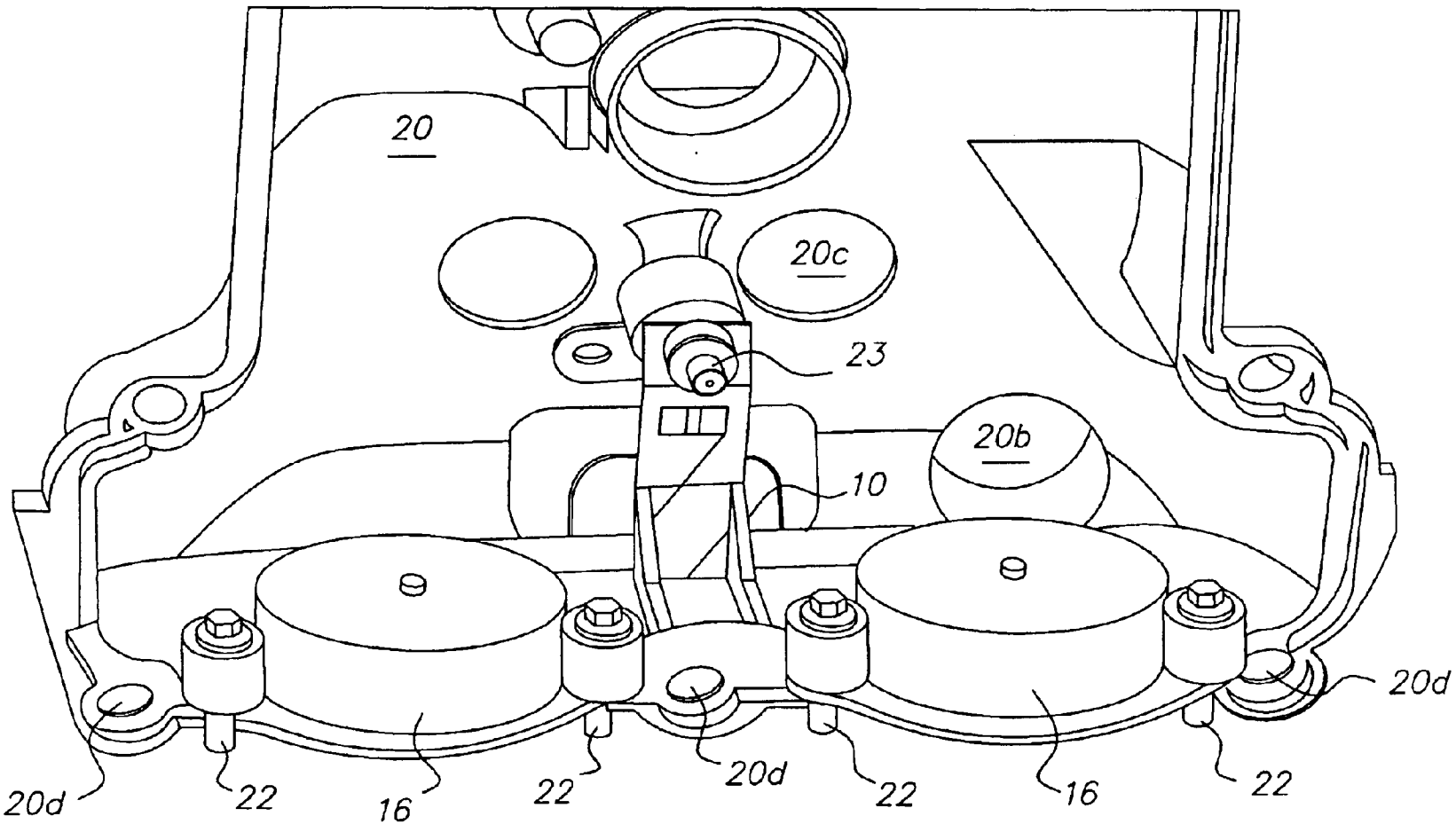
FIG. 1 shows an inside view of elements inside the cam cover of the present invention.

Referring to FIGS. 1–8, a one piece leadframe/housing 10 made of materials such as plastic and copper alloys as electrical connecting elements therein is provided. The lead frame 10 has a single integrally sealed electrical connector 12 and a number of "M" slot connections 14. "M" slot connections 14 are used for connecting variable force solenoid (VFS) actuators 16, sprocket sensors (not shown), and other sensors (also not shown). The leadframe/housing 10 is designed to have individual actuators and sensors be independently field serviceable.

An "M" slot has an opening having the shape of the alphabet "M" with flat stamped leads. "M" slot's use includes receiving a solenoid terminal blade, wherein the blade is inserted through the opening.

Referring specifically to FIG. 1, elements inside the cam cover 20 of the present invention is depicted. Lead frame/housing 10 retains and accurately positions a pair of solenoids 16 such as variable force solenoids (VFS) for controlling or actuating a pair of spool valves (not shown) for a pair of VCT phasers 18 (see FIGS. 4–6). The moving or actuating element is in the center of each of the solenoids 16. The element comes in contact with a valve such as spool valve preferably in the center of the VCT phaser 18. A cam cover 20 is provided. The pair of solenoids 16 is mounted onto cam cover 20 by a plurality of fasteners 22. In other words, fasteners 22 transcend cam cover 20, variable force solenoid 16, and lead frame 10 in order to rigidly attach variable force solenoid 16 upon lead frame 10 and cam cover 20. Further, lead frame 10 also holds in place other elements such as an additional solenoid 23. As described supra, other elements such as sensors may also be held by lead frame 10 in a similar manner.

Figure 2:
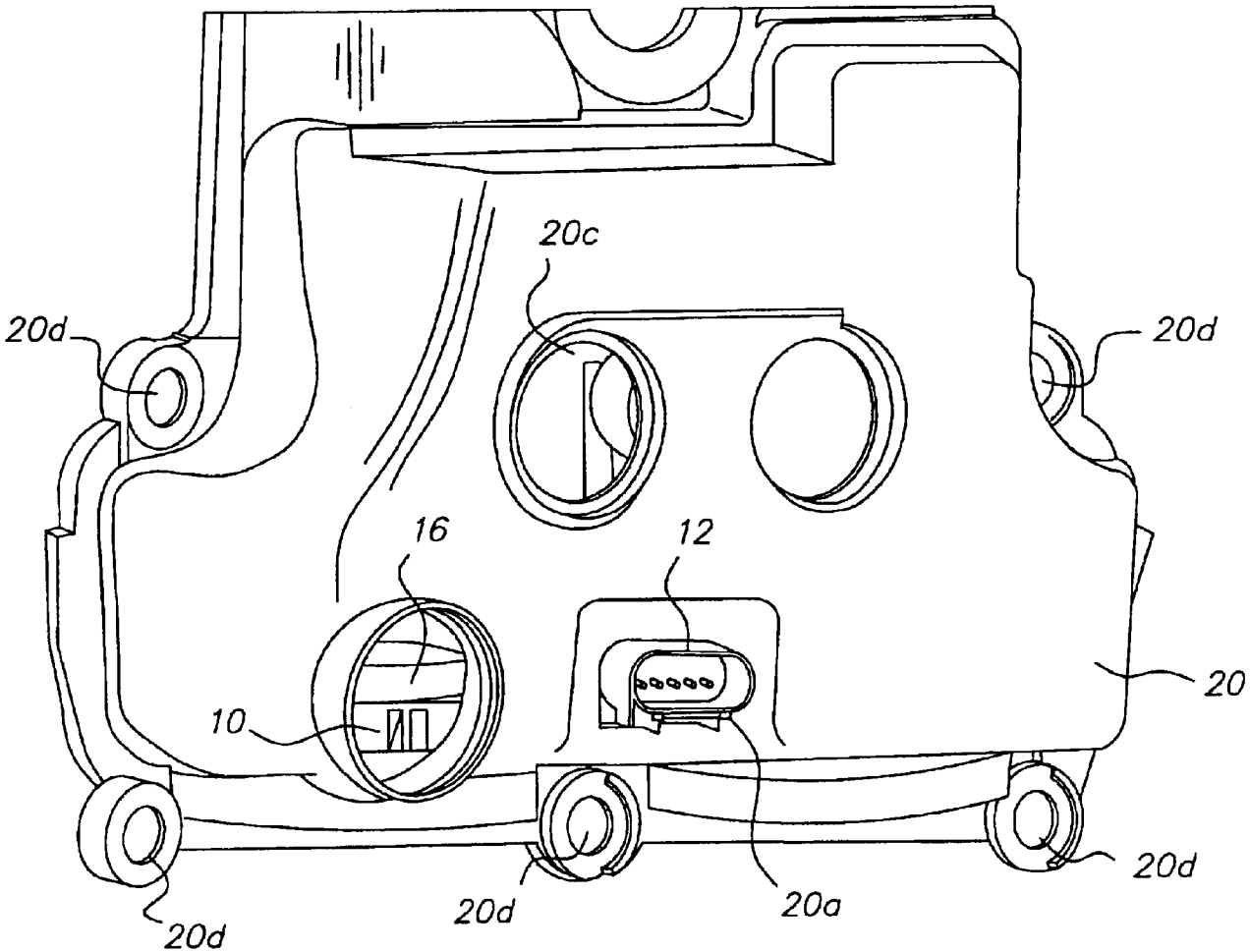
FIG. 2 shows an outside view of the cam cover of the present invention.
Figure 3:
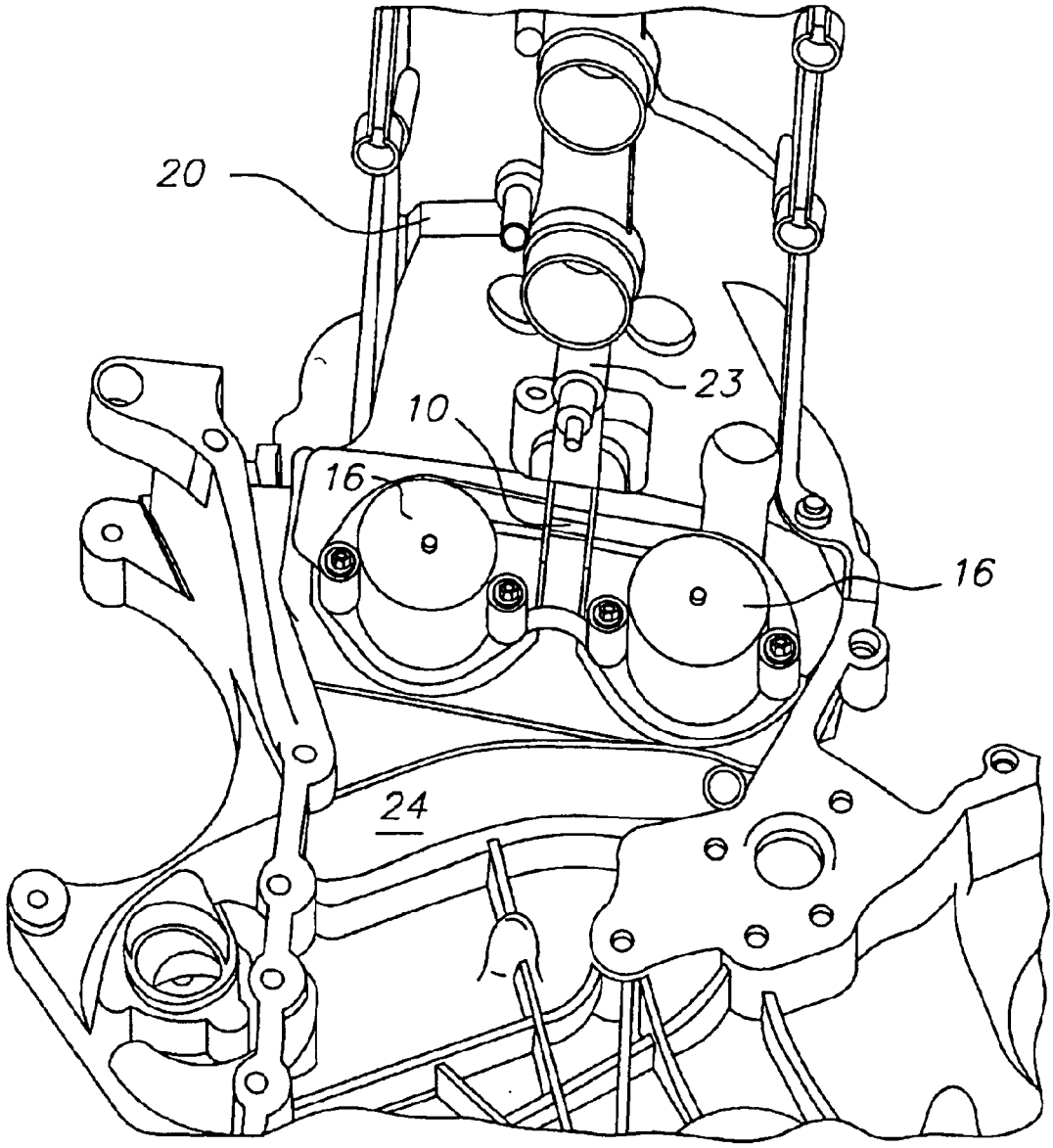
FIG. 3 shows elements inside the cam cover and engine front cover of the present invention.

Referring to FIG. 2, an outside view of the cam cover of the present invention is depicted. As can be seen, electric connector 12 extends through an electric connector opening 20*a*. Electric connector 12 has a plurality of pins therein for electrically connecting to other devices (not shown) such as an engine control unit (ECU) for sending out and receiving signals. Through openings 20*b* (not shown) and 20*c* lead frame 10, variable force solenoid 16, and second solenoid 23 on the other side of cam cover 20 are partially shown. Openings 20*d* and 20*c* are used for affixing cam cover 20 to an engine cover 24 (see FIG. 3), and the cylinder head (not shown).

Figure 4:
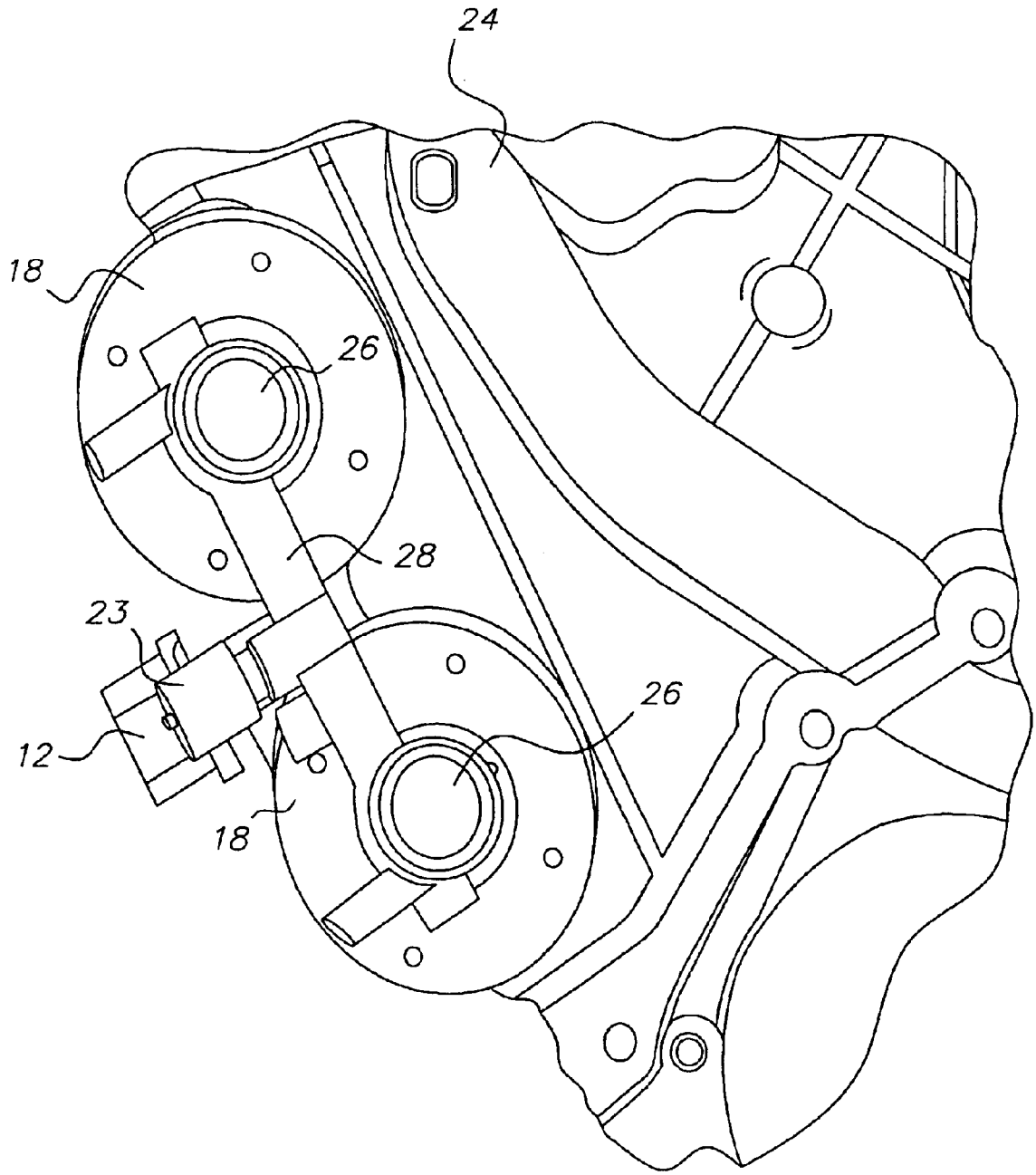
FIG. 4 shows a first view of elements inside the engine front cover of the present invention.
Figure 5:
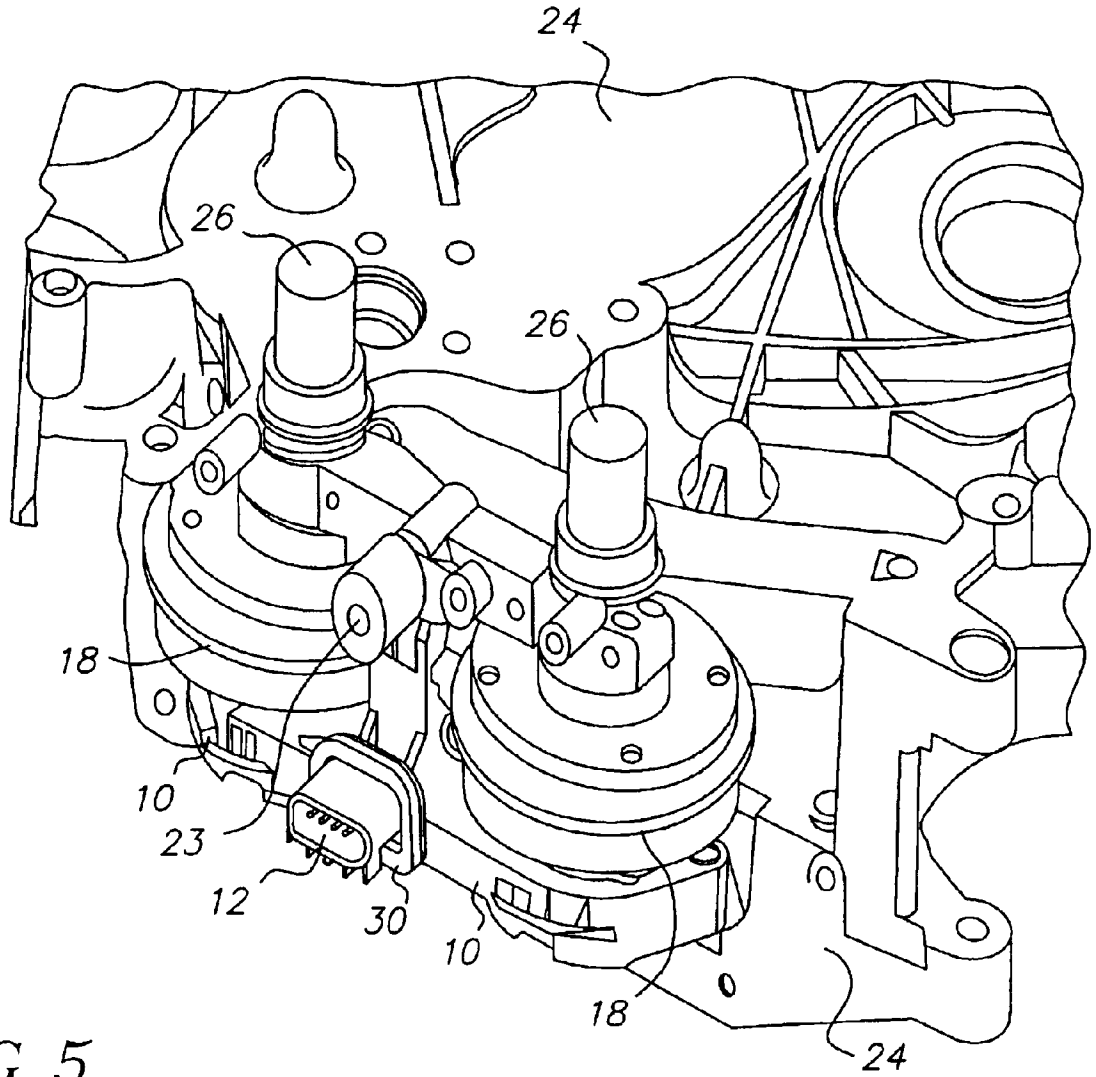
FIG. 5 shows a second view of elements inside the engine front cover of the present invention.
Figure 6:
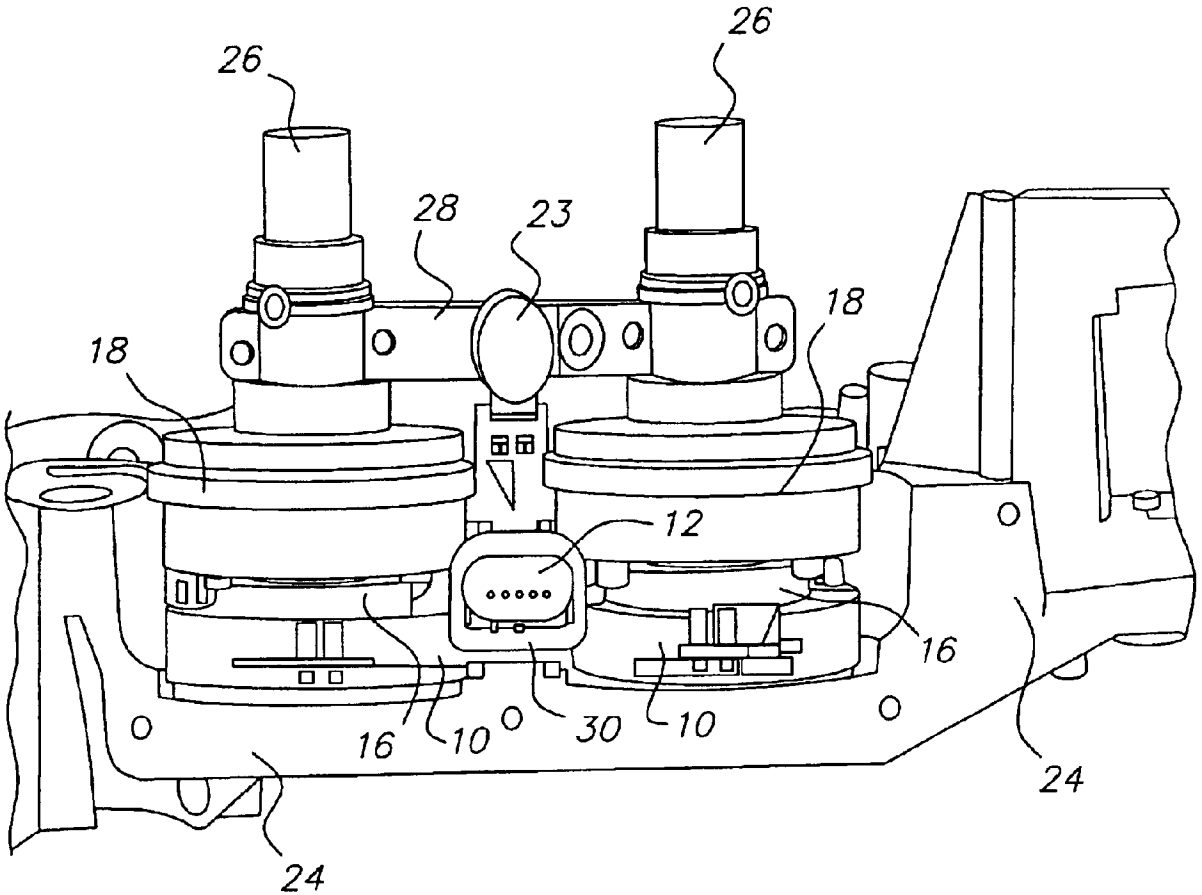
FIG. 6 shows a third view of elements inside the engine front cover of the present invention.

Referring to FIGS. 4–6, three views from inside engine cover 24 are shown. A pair of camshafts 26 is provided, which are supported by bearing support 28. A sealing element 30 such as a gasket is disposed between lead frame 10 and cam cover 20 in order to seal the inside of cam cover 20 from outside. VCT phaser 18 has a first portion thereof affixed to camshafts 26 and a second portion angularly adjustable in relation to the first portion. VCT phaser 18 are positioned in such as way that variable force solenoid 16 can act thereon respectively upon a valve (not shown) located in the center of VCT phaser 18 for the angularly adjustable VCT phaser 18. Note that there is no contact between lead frame 10 and VCT phaser 18 except the location wherein actions upon the valve occur.

Figure 7:
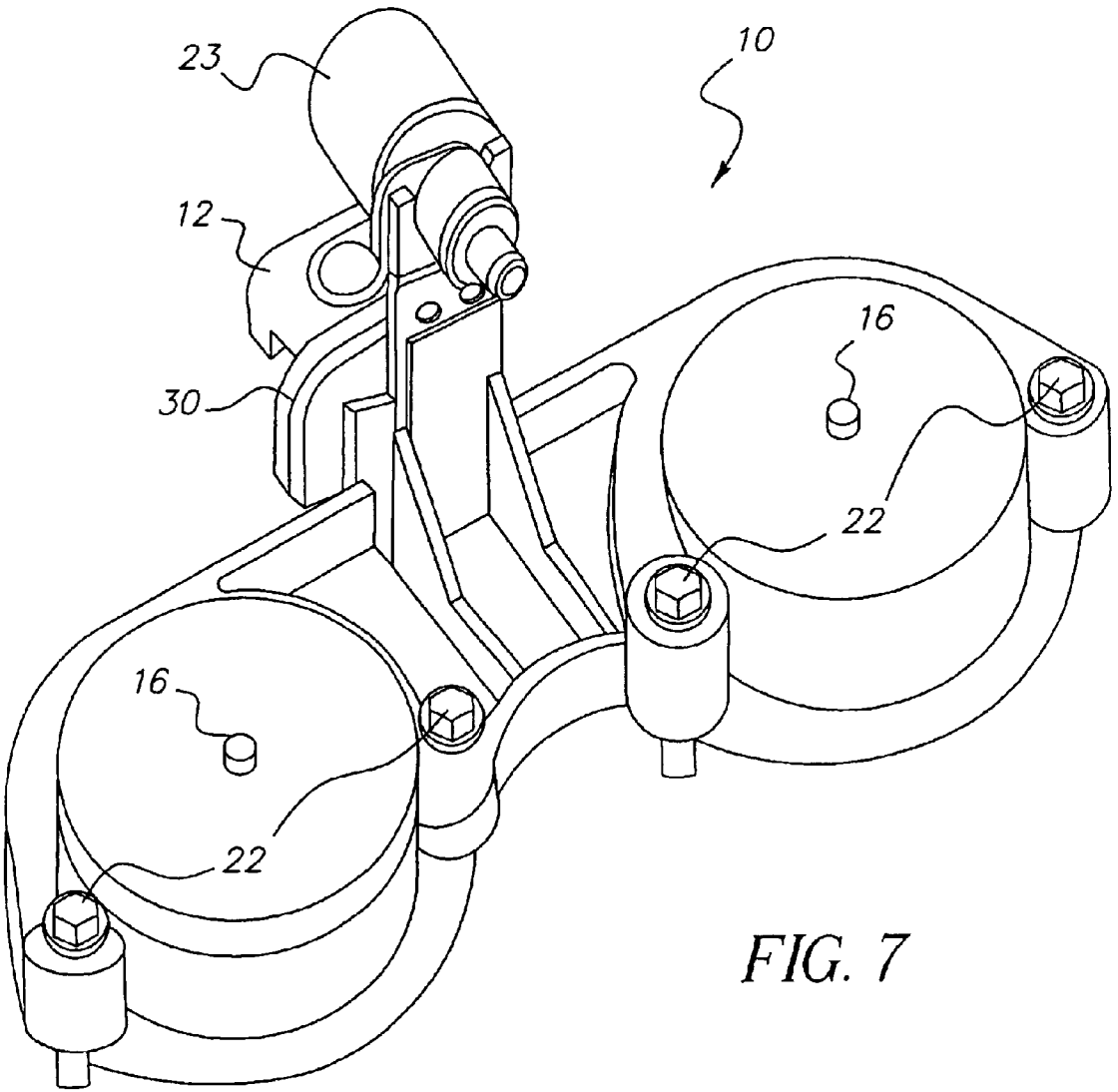
FIG. 7 shows a first view of a lead frame of the present invention electrically connecting, positioning, and securing the elements
Figure 8A:
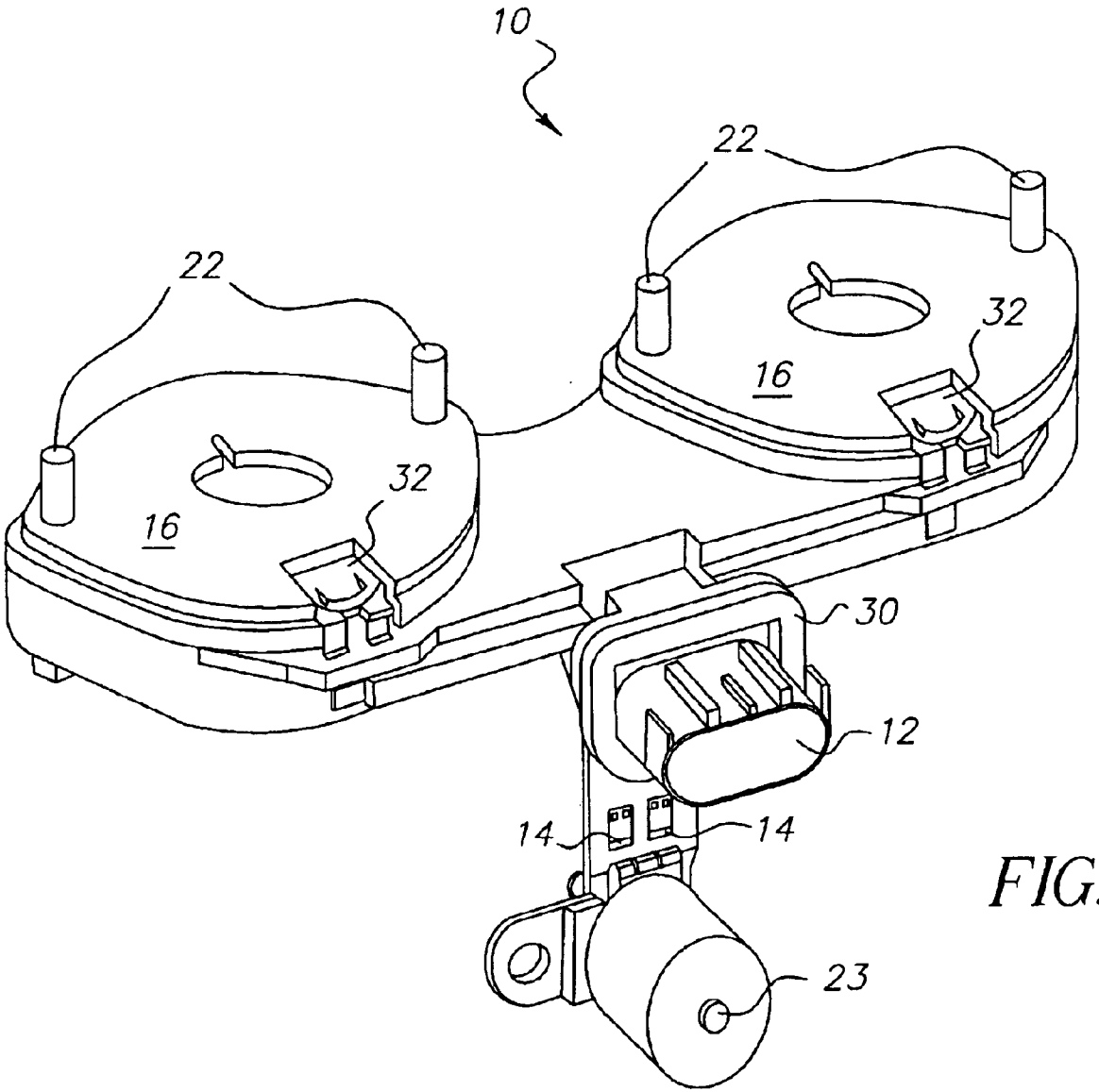
FIG. 8A shows a second view of the lead frame of the present invention electrically connecting and holding the elements.

Referring to FIGS. 7 and 8A, two views of lead frame 10 electronically connecting and physically rigidly affixing various elements including second solenoid 23, variable force solenoid 16, and other suitable elements are depicted. "M" slots 14 thereon are used to electrically connect and physically rigidly affix some of the other suitable elements. Further, lead heads 32 may be used to electrically connect and/or physically rigidly affix variable force solenoid 16 on lead frame 10.

Figure 8B:
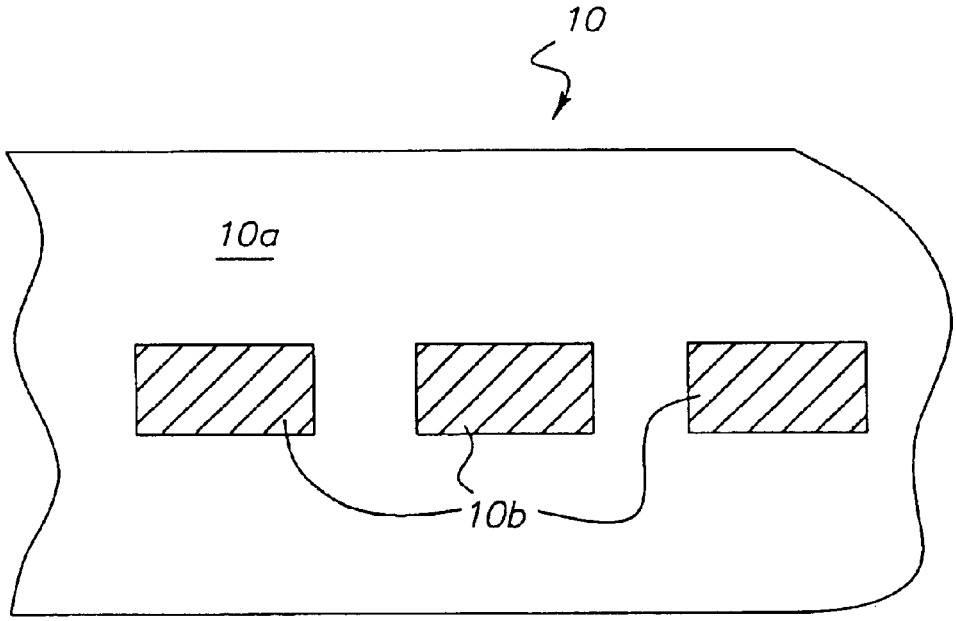
FIG. 8B shows an inside structure of a lead frame of the present invention.

Referring to FIG. 8B, the inside structure of lead frame 10 is shown. Lead frame 10 includes insulating member 10*a* and electrically conducting path 10*b*. Lead frame 10 may include more than one independently electrically conducting paths 10*b*.

As can be appreciated, lead frame 10 electrically connects and physically rigidly affixes various elements inside engine cover 24 or cam cover 20. Further lead frame 10 saves multiple wire runs inside engine cover 24 or cam cover 20 as well.

The leadframe design of the present invention includes the following features: Increased reliability of the VCT system due to the reduction of electrical connections which are chronic weak points of any electrical system; decreased likelihood of oil leaks or foreign matter infiltration to the engine because only one electrical connector to the outside may be used; and overall savings in components and labor because the leadframe replaces many components with one, and assembly is simplified. The cost savings in such matters as reduced warranty should be apparent, as well.

The shape of lead frame 10 can vary according the usage. Lead frame 10 does not need to be fixed in the shape as shown in FIGS. 1–8. Different applications may require different shapes.

It should be noted the lead frame 10 taught in the present invention is different from the lead frames in the computer chip manufacturing art in that the present invention provides a single seal between components inside the engine cover and components outside the engine cover. Further, semiconductor chip encapsulation is not involved in the present invention. Further, lead frame 10 may be installed in any type of engines such as V-type, I-type, L-type, etc.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes exist on camshaft to push on valves. In a multiple camshaft engine, most often has one shaft for exhaust valves, one shaft for intake valves. A "V" type engine may have one camshaft (Overhead valve or OHV); for overhead cam (OHC) engines, two camshafts (one for each bank), or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid low in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system that changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a camshaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) generically refers to any process that dynamically changes the valve opening and closing events. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A lead frame for mounting a plurality of variable cam timing system devices within the confines of a cam cover, the lead frame comprising:

a frame of insulating material for retaining or positioning of at least some of the variable cam timing system devices within the cam cover;

an electrical connector having a plurality of electrically conducting terminals accessible from outside the cam cover; and a plurality of electrically conductive paths formed internal to insulating material of the frame, in electrical communication with at least some of the devices and the electrically conducting terminals, such that the frame, the connector and the paths form a single integral lead frame housing.

2. The lead frame of claim 1, wherein the electrical connector member is disposed to allow a single electrical connection point with the devices within the engine and to a plurality of other components of the vehicle.

3. The lead frame of claim 1, wherein at least one of the devices is a solenoid.

4. The lead frame claim, wherein the plurality of electrically conducting terminals are pins, blades, or other convenient shape.

* * * * *

UNITED STATES PATENT AND TRADEMARK OFFICE

CERTIFICATE OF CORRECTION

PATENT NO. : 6,904,880 B2
DATED : June 21, 2005
INVENTOR(S) : Green et al.

It is certified that error appears in the above-identified patent and that said Letters Patent is hereby corrected as shown below:

Column 6,
Line 49, "frame claim, wherein" should be changed to -- frame of claim 1, wherein --.

Signed and Sealed this

Sixteenth Day of August, 2005

JON W. DUDAS
*Director of the United States Patent and Trademark Office*